US009423177B2

(12) United States Patent
Walker et al.

(10) Patent No.: US 9,423,177 B2
(45) Date of Patent: Aug. 23, 2016

(54) FORCE-BALANCING GAS FLOW IN DRYERS FOR PRINTING SYSTEMS

(71) Applicants: Casey E. Walker, Boulder, CO (US); Scott Johnson, Erie, CO (US); Stuart J. Boland, Denver, CO (US); William Edward Manchester, Erie, CO (US); Sean K. Fitzsimons, Thornton, CO (US)

(72) Inventors: Casey E. Walker, Boulder, CO (US); Scott Johnson, Erie, CO (US); Stuart J. Boland, Denver, CO (US); William Edward Manchester, Erie, CO (US); Sean K. Fitzsimons, Thornton, CO (US)

(73) Assignee: Ricoh Company, Ltd., Tokyo (JP)

( * ) Notice: Subject to any disclaimer, the term of this patent is extended or adjusted under 35 U.S.C. 154(b) by 464 days.

(21) Appl. No.: 13/774,467

(22) Filed: Feb. 22, 2013

(65) Prior Publication Data

US 2014/0237848 A1 Aug. 28, 2014

(51) Int. Cl.

| | |
|---|---|
| ***F26B 3/00*** | (2006.01) |
| ***B41L 35/14*** | (2006.01) |
| ***B41L 41/00*** | (2006.01) |
| ***F26B 3/28*** | (2006.01) |
| ***F26B 13/20*** | (2006.01) |

(52) U.S. Cl.

CPC ..... *F26B 3/28* (2013.01); *F26B 13/104* (2013.01)

(58) Field of Classification Search

CPC ..... F26B 13/008; F26B 13/108
USPC ..... 34/643, 644, 464, 461; 101/488, 424.1; 162/272

See application file for complete search history.

(56) References Cited

U.S. PATENT DOCUMENTS

| | | | | |
|---|---|---|---|---|
| 602,799 | A * | 4/1898 | Burns | F26B 13/104 34/643 |
| 3,002,700 | A * | 10/1961 | Mohring | 239/455 |
| 3,287,821 | A * | 11/1966 | Schregenberger | D21F 5/00 34/643 |
| 3,720,002 | A * | 3/1973 | Martin | D06C 7/00 34/421 |
| 5,094,678 | A * | 3/1992 | Kramer | C03B 27/0404 65/104 |
| 5,524,363 | A * | 6/1996 | Seidl et al. | 34/629 |
| 7,052,124 | B2 | 5/2006 | Pickup | |
| 7,907,873 | B2 | 3/2011 | Sandler et al. | |
| 8,282,781 | B2 | 10/2012 | Shakespeare | |
| 8,313,260 | B2 | 11/2012 | Nouhant et al. | |
| 8,317,185 | B1 | 11/2012 | Herrmann | |
| 8,328,321 | B2 | 12/2012 | Tsuzawa | |
| 2011/0199481 | A1* | 8/2011 | Silis | 348/143 |

* cited by examiner

*Primary Examiner* — Kenneth Rinehart
*Assistant Examiner* — John McCormack
(74) *Attorney, Agent, or Firm* — Duft Bornsen & Fettig LLP

(57) ABSTRACT

Systems and methods are provided for balancing air flow in dryers of printing systems. The dryer includes a heating element, top flow generator, and bottom flow generator. The heating element is within the dryer, and heats a web of printed media. The top flow generator directly projects a first jet of gas onto a top side of the web. The first jet of gas deflects air proximate to the web. The bottom flow generator directly projects a second jet of gas onto an opposing side of the web. The second jet strikes the web at substantially the same location as the first jet, and compensates orthogonal force applied to the web by the first jet. Furthermore, the top and bottom flow generators are both oriented to project the jets partially in the direction of travel of the web.

20 Claims, 5 Drawing Sheets

FORCE-BALANCING GAS FLOW IN DRYERS FOR PRINTING SYSTEMS

FIELD OF THE INVENTION

The invention relates to the field of dryers, and in particular, to dryers that actively generate airflow when drying printed media.

BACKGROUND

Businesses or other entities having a need for volume printing typically purchase a production printer. A production printer is a high-speed printer used for volume printing (e.g., one hundred pages per minute or more). Production printers are typically continuous-form printers that print on webs of print media that are stored on large rolls.

A production printer typically includes a localized print controller that controls the overall operation of the printing system, and a print engine (sometimes referred to as an "imaging engine" or as a "marking engine"). The print engine includes one or more printhead assemblies, with each assembly including a printhead controller and a printhead (or array of printheads). An individual printhead includes multiple tiny nozzles (e.g., 360 nozzles per printhead depending on resolution) that are operable to discharge ink as controlled by the printhead controller. A printhead array is formed from multiple printheads that are spaced in series across the width of the print media.

While the production printer is in operation, the web of print media is quickly passed underneath the printhead arrays while the nozzles of the printheads discharge ink at intervals to form pixels on the web. Some types of media used in inkjet printers are better suited to absorb the ink, while other types are not. Thus, a radiant dryer may be installed downstream from the printer. The radiant dryer assists in drying the ink on the web after the web leaves the printer. A typical radiant dryer includes an array of lamps that emit light and heat. The light and heat from the lamps helps to dry the ink as the web passes through the dryer.

In order to facilitate drying of the web, air may be actively forced through the dryer so that moisture-saturated air is driven out of the dryer, while dry air is brought into the dryer. However, active air flow can cause flutter at the web, which can result in warps and tears along the web, and may even break the web. Thus, it is undesirable to implement any active airflow that directly strikes the web. Furthermore, rollers are rarely used within the interior of a dryer to tension the web and prevent such flutter, because when tensioned rollers are heated to the operating temperature of the dryer, the rollers increase the risk of igniting the portion of the web that they are in contact with. Thus, web flutter in dryers that actively exchange air remains a problem.

SUMMARY

Embodiments described herein provide flow generators in a dryer that drive opposing jets of gas (e.g., air) onto opposite sides of a web of printed media as the web travels through a dryer. The jets balance out forces from each other that would otherwise warp or bend the web. The jets also move the air inside of the dryer along the direction of travel of the web and towards an exit.

One embodiment is dryer for a printing system. The dryer includes a heating element, a top flow generator, and a bottom flow generator. The heating element is within an interior of the dryer, and heats a web of printed media as the web travels across the interior. The top flow generator is within the interior, and directly projects a first jet of gas onto a top side of the web. The first jet of gas deflects air proximate to the web. The bottom flow generator is within the interior, and directly projects a second jet of gas onto an opposing side of the web. The second jet strikes the web at substantially the same location as the first jet, and compensates orthogonal force applied to the web by the first jet. Furthermore, the top and bottom flow generators are both oriented to project the jets partially in the direction of travel of the web.

Another embodiment is a method. The method includes driving a web of printed media through an interior of a dryer, and operating a heating element within the interior of the enclosure to heat a web of printed media as the web travels across the interior. The method also includes directly projecting a first jet of gas onto a top side of the web that deflects air proximate to the web within the interior. Further, the method includes directly projecting a second jet of gas onto an opposing side of the web that deflects air proximate to the web within the interior. The second jet strikes the web at substantially the same location as the first jet and compensates orthogonal force applied to the web by the first jet, and the first and second jets are projected partially in the direction of travel of the web.

Other exemplary embodiments (e.g., methods and computer-readable media relating to the foregoing embodiments) may be described below.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
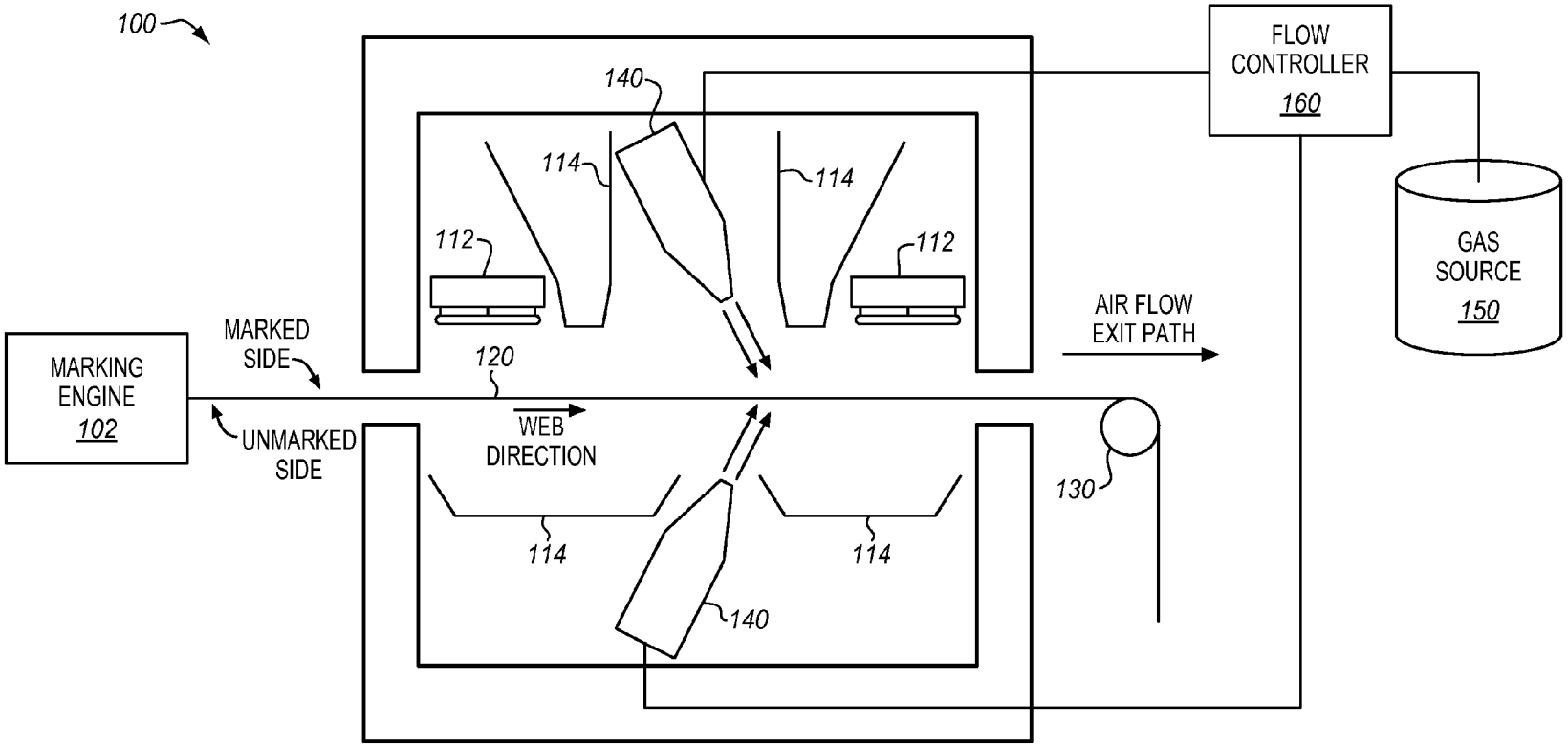
FIG. 1 is a diagram of a drying system in an exemplary embodiment.

FIG. 1 is a diagram of a drying system 100 in an exemplary embodiment. Drying system 100 receives web of printed media 120 that has been marked by an upstream marking engine 102 and partially tensioned by roller 130, which is located outside of drying system 100. Drying system 100 dries web 120 with one or more heating elements 112, such as radiant heat lamps. Radiant energy from heating elements 112 is reflected by thermal reflectors 114 in order to reduce waste heat and also to keep drying system 100 from overheating.

Drying system 100 has been enhanced to include flow generators 140, which project impinging jets of gas directly onto web 120 as web 120 travels through drying system 100. One flow generator 140 is located above web 120 and projects a jet downward onto web 120, while another flow generator 140 is located below web 120 and projects a jet upward into substantially the same location on web 120.

The jets increase the rate at which air is exchanged with within drying system 100. This ensures that air within the dryer that is already saturated with moisture is quickly cycled out of drying system 100. Additionally, the forces applied by the complementary jets can tension web 120 while web 120 is within drying system 120, without placing a roller within the interior of drying system 100 and thereby increasing the risk of fire.

Gas source 150 provides a supply of gas to flow generators 140, and may comprise a compressor or pressurized container. Flow controller 160 manages the rate at which gas is supplied to flow generators 140 from gas source 150. For example, flow controller 160 may comprise a manual valve. In some embodiments, flow controller 160 comprises an electronically implemented controller (e.g., a circuit, or a processor implementing programmed instructions), that is capable of actively controlling the rate at which gas travels to flow generators 140. Flow controller 160 may further provide a different rate of flow to top flow generator 140 than to bottom flow generator 140. This may be done, for example, in response to detected variations in pressure from gas source 150, to compensate for any other conditions that may change the flow characteristics between the top and bottom flow generators 140, or for any other reason as desired.

Illustrative details of the operation of drying system 100 will be discussed with regard to FIG. 2. Assume, for this embodiment, that upstream marking engine 102 has marked web 120, and that web 120 is being received at drying system 100 for processing.

Figure 2:
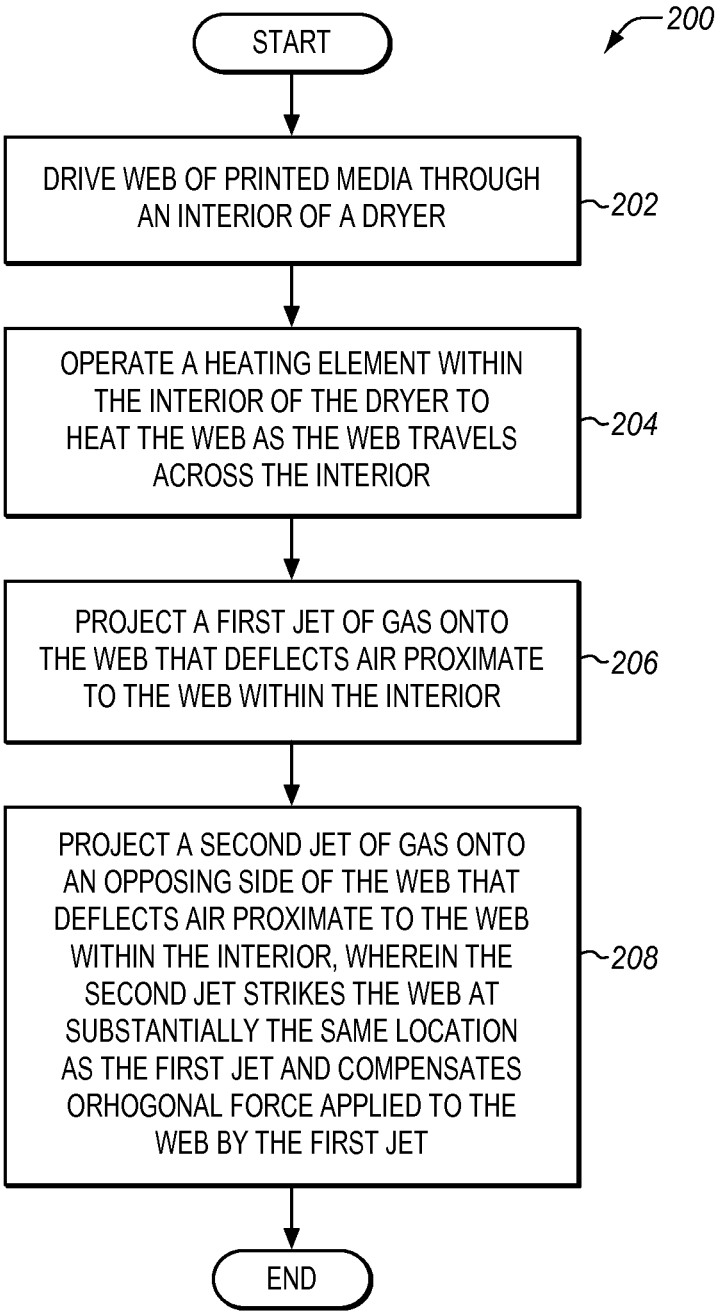
FIG. 2 is a flowchart illustrating a method for operating a drying system in an exemplary embodiment.

FIG. 2 is a flowchart illustrating a method 200 for operating a drying system in an exemplary embodiment. The steps of method 200 are described with reference to drying system 100 of FIG. 1, but those skilled in the art will appreciate that method 200 may be performed in other systems. The steps of the flowcharts described herein are not all inclusive and may include other steps not shown. The steps described herein may also be performed in an alternative order.

In step 202, web 120 is driven through drying system 100. For example, in one embodiment tensioned roller 130 drives web 120 through an interior of drying system 100. In step 204, heating elements 112 are operated to heat web 120 as web 120 travels across the interior of drying system 100.

In step 206, the airflow generator 140 (located above web 120) directly projects a top jet of gas onto web 120. The jet of gas extends into the page in FIG. 1 and along the width of web 120. The jet deflects air proximate to web 120 while web 120 is within the interior of drying system 100. The jet is projected at a sufficient speed and mass flow to substantially disrupt the laminar flow of a boundary layer of saturated, moist air at web 120. By generating turbulent and/or chaotic flow at web 120, flow generators 140 ensure that new, dry air is able to receive moisture from web 120 via convective mass transfer.

The top jet is oriented/angled so that it is partially projected in the direction of travel of web 120, and is partially projected orthogonal to web 120. This means that orthogonal force applied to web 120 by the top jet, if not compensated for, will deform web 120 downward.

In step 208, the airflow generator 140 (located below web 120) projects a bottom jet of gas onto web 120 that also deflects air proximate to web 120 while web 120 is within the interior of drying system 100. The bottom jet is applied at the same time as the top jet to substantially the same portion of web 120 as the top jet (but on a different side), and applies a compensating orthogonal force upward to balance the orthogonal force applied by the top jet. The bottom jet, like the top jet, is partially projected in the direction of travel of web 120.

By utilizing method 200 described above, a dryer can achieve multiple benefits at once. First, drying system 100 can enhance the flow of air along the interior, and can specifically disrupt laminar boundary layer flow for air proximate to a web of printed media. This means that new air which is not saturated with moisture can engage in convective mass transfer with marked portions of web 120. Second, because flow generators 140 apply complementary orthogonal forces to web 120, web 120 is not deformed by the jets of gas. Third, complementary flow generators 140 are oriented to apply substantially balancing orthogonal forces to web 120, which ensures that web 120 is properly positioned within drying system 100 without resorting to rollers, which may increase the risk of fire. Fourth, complementary flow generators 140 direct the flow of air along the direction of travel of web 120, and therefore towards an exit of drying system 100. This means that air is not driven towards marking engine 102, which would reduce print quality.

Figure 3:
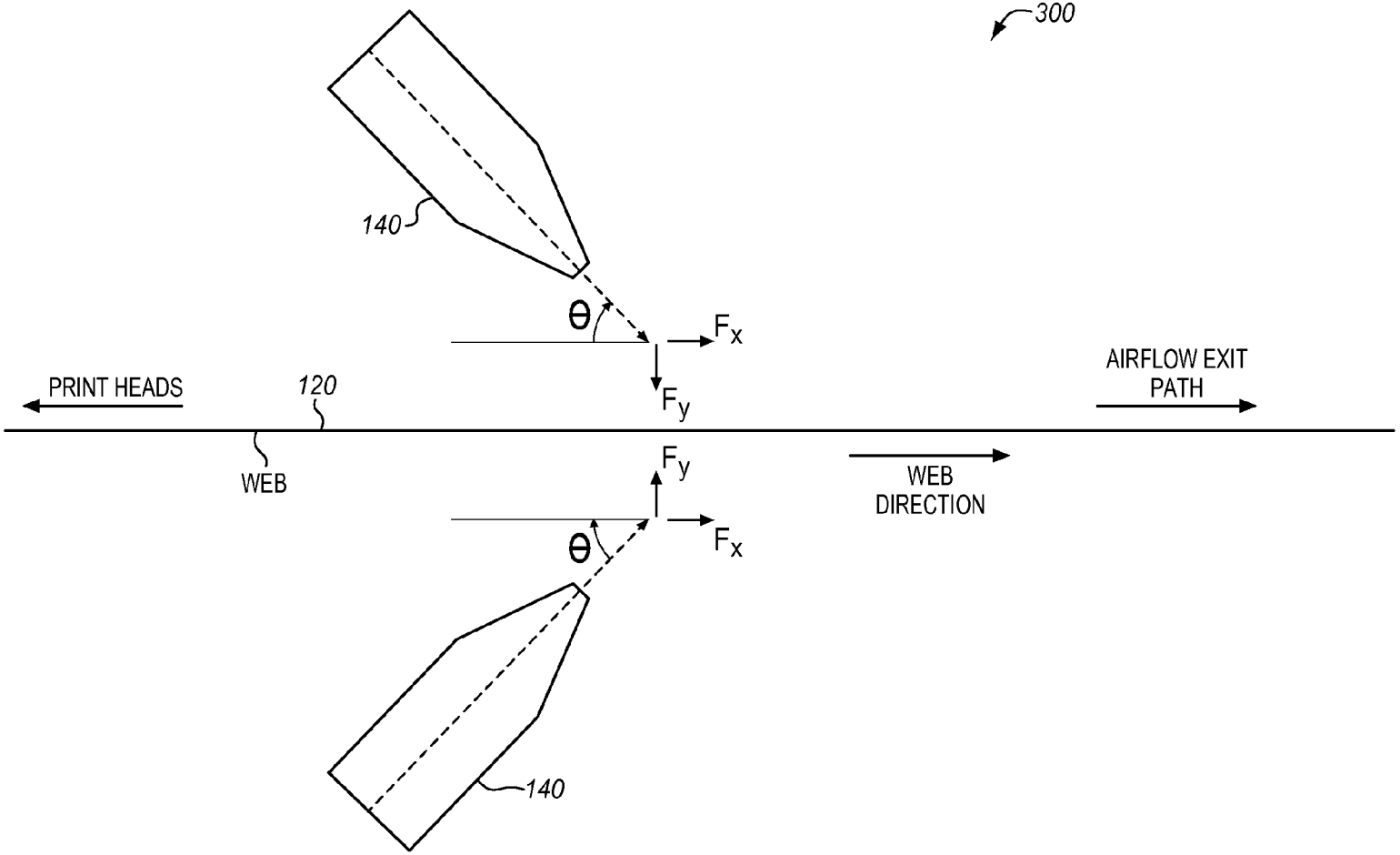
FIG. 3 is a diagram illustrating additional details of flow generators within a drying system in an exemplary embodiment.

FIG. 3 is a diagram 300 illustrating additional details of flow generators 140 within a drying system in an exemplary embodiment. FIG. 3 shows that each flow generator 140 is oriented to project a jet of air at an angle of attack (8) toward web 120. The jets projected at the angle of attack each include a vertical component and a horizontal component, resulting in vertical force applied to web 120 ($F_y$) and a horizontal force applied to web 120 ($F_x$). The vertical force applied by the top jet from the top flow generator 140 is compensated by the vertical force applied by the bottom jet from the bottom flow generator. As the vertical force is a function of the combination of linear speed, mass flow, and angle of attack, the top jet and the bottom jet may exhibit the same or different combinations of these variables, so long as the vertical forces are properly balanced. In one embodiment, the forces are balanced to account for the effect of gravity on the web, thereby improving the position of the paper in low tensioned systems. In such embodiments, the bottom jet may exert a larger force onto the web than the top jet, in order to compensate for the force of gravity.

Flow generators 140 may comprise air knives that have a nozzle width (W) into the page that substantially matches the width of web 120. The nozzles of flow generators 140 may also have a length (L), and the nozzles may be located a distance (D) away from web 120. In one embodiment, the ratio of L to D is about 1:7. Flow generators 140 may project any suitable gas such as air, carbon dioxide, nitrogen, argon, etc.

Examples

In the following examples, additional processes, systems, and methods are described in the context of a dryer that processes a printed web of media.

Figure 4:
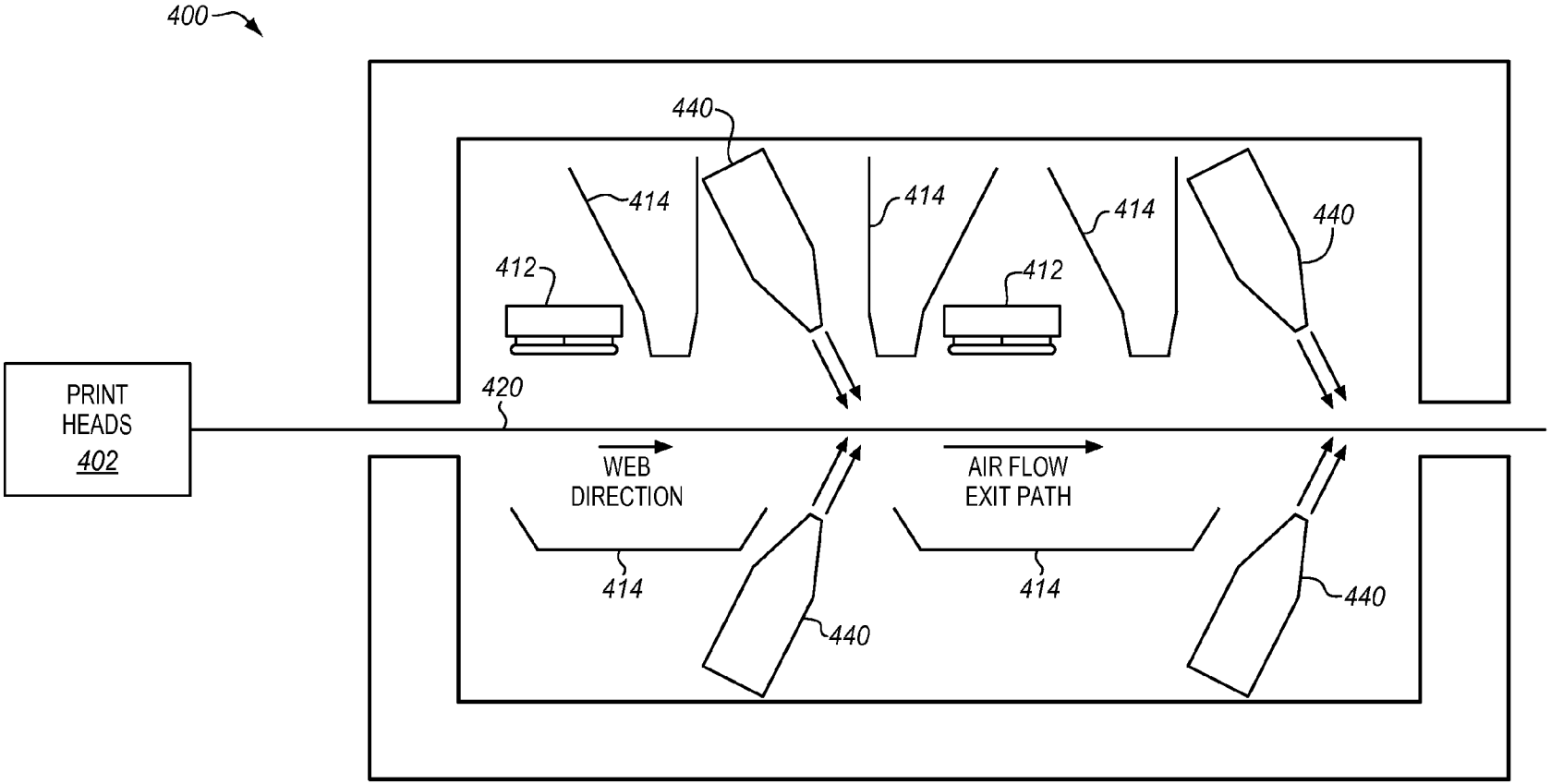
FIG. 4 is a diagram illustrating a further drying system in an exemplary embodiment.

FIG. 4 is a diagram illustrating a drying system 400 in an exemplary embodiment. According to FIG. 4, web 420 comprises a web of paper that has been inked by print heads 402 of an upstream continuous-forms inkjet printer. The ink on web 420 is still wet as it enters drying system 400. As web 420 travels through drying system 400 at a linear velocity of five feet per minute, web 420 is alternately heated by radiant heat lamps 412 and cooled by air knives 440. Air knives 440 are driven by pressure generated at an air compressor, and air knives 440 are protected from radiant heating by reflectors 114. Air knives 440 have a slot width of one millimeter, and project ambient temperature air at a rate of twenty feet per second onto the surface of web 420, at a distance of one centimeter from the surface of web 420 at about a forty five degree angle of attack to web 420. Air knives 440 are arranged in complementary pairs so that the vertical forces applied to web 420 substantially compensate each other and web 420 is not deflected. Furthermore, each pair of air knives 440 projects jets of air along the direction of travel of web 420, and away from print heads 402. This prevents disruptive air flow from interfering with the aerial dispersal of ink droplets onto web 420.

Figure 5:
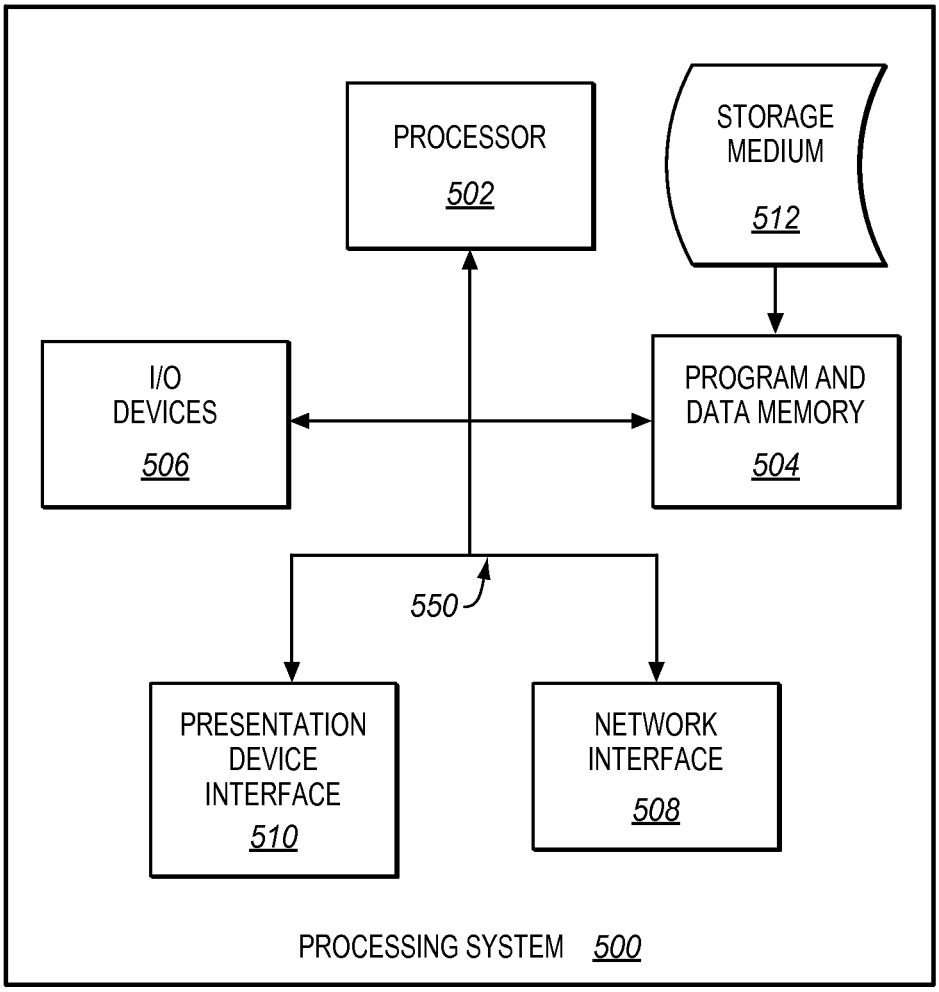
FIG. 5 illustrates a processing system operable to execute a computer readable medium embodying programmed instructions to perform desired functions in an exemplary embodiment.

In one particular embodiment, software is used to direct a processing system of flow controller 160 to dynamically regulate the amount of gas flow supplied to one or more flow generators (e.g., based on a determined speed of a web of print media). FIG. 5 illustrates a processing system 500 operable to execute a computer readable medium embodying programmed instructions to perform desired functions in an exemplary embodiment. Processing system 500 is operable to perform the above operations by executing programmed instructions tangibly embodied on computer readable storage medium 512. In this regard, embodiments of the invention can take the form of a computer program accessible via computer-readable medium 512 providing program code for use by a computer or any other instruction execution system. For the purposes of this description, computer readable storage medium 512 can be anything that can contain or store the program for use by the computer.

Computer readable storage medium 512 can be an electronic, magnetic, optical, electromagnetic, infrared, or semiconductor device. Examples of computer readable storage medium 512 include a solid state memory, a magnetic tape, a removable computer diskette, a random access memory (RAM), a read-only memory (ROM), a rigid magnetic disk, and an optical disk. Current examples of optical disks include compact disk-read only memory (CD-ROM), compact disk-read/write (CD-R/W), and DVD.

Processing system 500, being suitable for storing and/or executing the program code, includes at least one processor 502 coupled to program and data memory 504 through a system bus 550. Program and data memory 504 can include local memory employed during actual execution of the program code, bulk storage, and cache memories that provide temporary storage of at least some program code and/or data in order to reduce the number of times the code and/or data are retrieved from bulk storage during execution.

Input/output or I/O devices 506 (including but not limited to keyboards, displays, pointing devices, etc.) can be coupled either directly or through intervening I/O controllers. Network adapter interfaces 508 may also be integrated with the system to enable processing system 500 to become coupled to other data processing systems or storage devices through intervening private or public networks. Modems, cable modems, IBM Channel attachments, SCSI, Fibre Channel, and Ethernet cards are just a few of the currently available types of network or host interface adapters. Presentation device interface 510 may be integrated with the system to interface to one or more presentation devices, such as printing systems and displays for presentation of presentation data generated by processor 502.

Although specific embodiments were described herein, the scope of the invention is not limited to those specific embodiments. The scope of the invention is defined by the following claims and any equivalents thereof.

We claim:

1. A dryer comprising:

multiple heating elements that are operable to directly radiate heat onto a web of printed media as the web travels through an interior of the dryer;

a top flow generator that is located within the interior and is operable to directly project a first jet of gas onto a top side of the web that deflects air proximate to the web; and a bottom flow generator that is located within the interior and is operable to directly project a second jet of gas onto an opposing side of the web, wherein the second jet strikes the web at substantially the same location as the first jet and applies an amount of orthogonal force to the web equal to an amount of orthogonal force applied to the web by the first jet, thereby preventing the web from deflecting vertically while in the dryer, which ensures that the web does not change its distance with respect to one of the multiple heating elements, wherein the top and bottom flow generators are both oriented to project the jets partially in the direction of travel of the web without projecting air against the direction of travel of the web, and the top flow generator is located between the heating elements along the direction of travel.

2. The dryer of claim 1 wherein:

the flow generators are operable to project the jets at substantially the same angle of attack to the web.

3. The dryer of claim 1 wherein:

at least one flow generator is further operable to project a jet at a speed that generates turbulent flow at the web.

4. The dryer of claim 1 wherein:

at least one flow generator comprises an air knife.

5. The dryer of claim 1 wherein:

at least one jet of gas comprises ambient temperature air.

6. The dryer of claim 1 wherein:

at least one flow generator comprises an exit nozzle having a width substantially equal to the width of the web and a length L;

the distance from the exit nozzle to the web is D; and the ratio of L to D is substantially one to seven.

7. The dryer of claim 1 wherein:

at least one flow generator is further operable to project a jet at a rate of mass flow that generates turbulent flow at the web and deflects the heated air proximate to the web.

8. The dryer of claim 1 wherein:

the top flow generator projects the first jet at substantially the same speed as the bottom flow generator projects the second jet.

9. The dryer of claim 1 wherein:

the top flow generator projects the first jet at substantially the same rate of mass flow as the bottom flow generator projects the second jet.

10. The dryer of claim 1 wherein:

the flow generators are separated from the heating elements along the direction of travel by thermal reflectors.

11. A method comprising:

driving a web of printed media through an interior of a dryer;

operating multiple heating elements within the interior of the dryer to directly radiate heat onto a web of printed media as the web travels across the interior;

directly projecting, via a top flow generator, a first jet of gas onto a top side of the web that deflects air proximate to the web within the interior; and directly projecting, via a bottom flow generator, a second jet of gas onto an opposing side of the web that deflects air proximate to the web within the interior, wherein the second jet strikes the web at substantially the same location as the first jet and applies an amount of orthogonal force to the web corresponding to an amount of orthogonal force applied to the web by the first jet, thereby preventing the web from deflecting vertically while in the interior, which ensures that the web does not change its distance with respect to one of the multiple heating elements, and wherein the first and second jets are projected partially in the direction of travel of the web without projecting air against the direction of travel of the web, and the top flow generator is located between the heating elements along the direction of travel.

12. The method of claim 11 further comprising:

projecting the jets at substantially the same angle of attack to the web.

13. The method of claim 11 further comprising:

projecting a jet at a speed that generates turbulent flow at the web.

14. The method of claim 11 further comprising:

projecting a jet with an air knife.

15. The method of claim 11 further comprising:

projecting a jet as ambient temperature air.

16. The method of claim 11 wherein:

a jet is projected by a flow generator that comprises an exit nozzle having a width substantially equal to the width of the web and a length L;

the distance from the exit nozzle to the web is D; and the ratio of L to D is substantially one to seven.

17. The method of claim 16 wherein:

the flow generators are separated from the heating elements along the direction of travel by thermal reflectors.

18. The method of claim 11 further comprising:

projecting a jet at a rate of mass flow that generates turbulent flow at the web and deflects the heated air proximate to the web.

19. The method of claim 11 further comprising:

projecting the first jet at substantially the same speed as the second jet.

20. The method of claim 11 further comprising:

projecting the first jet at substantially the same rate of mass flow as the second jet.

* * * * *